US007485200B2

(12) United States Patent
Ishida et al.

(10) Patent No.: US 7,485,200 B2
(45) Date of Patent: Feb. 3, 2009

(54) COPPER ALLOY AND METHOD OF MANUFACTURING THE SAME

(75) Inventors: Masahiko Ishida, Ohnuma-gun (JP); Junichi Kumagai, Aizuwakamatsu (JP); Takeshi Suzuki, Aizuwakamatsu (JP)

(73) Assignee: Mitsubishi Shindoh Co., Ltd., Tokyo (JP)

( * ) Notice: Subject to any disclaimer, the term of this patent is extended or adjusted under 35 U.S.C. 154(b) by 0 days.

(21) Appl. No.: 11/827,860

(22) Filed: Jul. 12, 2007

(65) Prior Publication Data

US 2008/0041507 A1 Feb. 21, 2008

Related U.S. Application Data

(62) Division of application No. 10/949,097, filed on Sep. 23, 2004, now Pat. No. 7,338,631.

(30) Foreign Application Priority Data

Apr. 14, 2004 (JP) ..... 2004-118968

(51) Int. Cl.
*C22F 1/08* (2006.01)

(52) U.S. Cl. ..... 148/680; 148/681; 148/682; 148/683; 148/684; 148/685

(58) Field of Classification Search ..... 148/680–695

See application file for complete search history.

(56) References Cited

U.S. PATENT DOCUMENTS

| | | | |
|---|---|---|---|
| 3,366,477 | A | 1/1968 | Eichelman, Jr. et al. |
| 3,830,644 | A | 8/1974 | Watanabe et al. |
| 5,582,281 | A | 12/1996 | Nakashima et al. |
| 6,093,499 | A | 7/2000 | Tomioka |
| 2002/0015657 | A1 | 2/2002 | Dong |
| 2002/0155021 | A1 | 10/2002 | Nagai |

(Continued)

FOREIGN PATENT DOCUMENTS

| | | |
|---|---|---|
| EP | 1180917 | 2/2002 |

(Continued)

OTHER PUBLICATIONS

Takagi, Kimura; Material, 34, 8 (1995), pp. 959.

(Continued)

*Primary Examiner*—Sikyin Ip
(74) *Attorney, Agent, or Firm*—Kolisch Hartwell, PC

(57) ABSTRACT

This copper alloy contains at least zirconium in an amount of not less than 0.005% by weight and not greater than 0.5% by weight, includes a first grain group including grains having a grain size of not greater than 1.5 μm, a second grain group including grains having a grain size of greater than 1.5 μm and less than 7 μm, the grains having a form which is elongated in one direction, and a third grain group including grains having a grain size of not less than 7 μm, and also the sum of α and β is greater than γ, and α is less than β, where α is a total area ratio of the first grain group, β is a total area ratio of the second grain group, and γ is a total area ratio of the third grain group, based on a unit area, and α+β+γ=1.

3 Claims, 8 Drawing Sheets

U.S. PATENT DOCUMENTS

| | | | |
|---|---|---|---|
| 2003/0095887 | A1 | 5/2003 | Dong |
| 2004/0140022 | A1 | 7/2004 | Inohana et al. |
| 2004/0159375 | A1 | 8/2004 | Yamagishi |

FOREIGN PATENT DOCUMENTS

| | | |
|---|---|---|
| JP | 61-041736 | 2/1986 |
| JP | S62-189738 | 8/1987 |
| JP | 63312936 | 12/1988 |
| JP | 2270946 | 11/1990 |
| JP | 03-243736 | 10/1991 |
| JP | 04-165055 | 6/1992 |
| JP | H07-258804 | 10/1995 |
| JP | 08-218155 | 8/1996 |
| JP | 9087814 | 3/1997 |
| JP | 10-060562 | 3/1998 |
| JP | 10081927 | 3/1998 |
| JP | 2000282156 | 10/2000 |
| JP | 2001131661 | 5/2001 |
| JP | 2002-356728 | 12/2002 |

OTHER PUBLICATIONS

Furukawa, Horita, Nemoto, TG. Landon: Metal, 70, 11 (2000), pp. 971.

*Microstructure and Mechanical Properties of Pure Copper by Accumulative Roll-Bonding (ARB) Process*, Journal of the JRICu vol. 41, No. 1 (2002).

*Preliminary Manuscript of 42nd Lecture of Japan Research Institute for Advanced Copper-Base Materials and Technologies*, pp. 55, Nov. 2002.

COPPER ALLOY AND METHOD OF MANUFACTURING THE SAME

CROSS-REFERENCE TO RELATED APPLICATION

This application is a divisional application of U.S. patent application Ser. No. 10/949,097, which was filed on Sep. 23, 2004, and which claims priority from Japanese Patent Application No. 2004-118968, filed Apr. 14, 2004, and which is hereby incorporated by reference in its entirety.

BACKGROUND OF THE INVENTION

1. Field of the Invention

The present invention relates to a copper alloy composed of fine grains whose form and orientation are controlled, and to a method of manufacturing the same.

2. Background Art

As described in Japanese Patent Application, First Publication No. 2002-356728, there has hitherto been known a technique of refining grains, which includes subjecting a base metal including a copper alloy to a rolling treatment and an aging treatment thereby to disperse fine precipitates, using a rolling method after subjecting to a solution treatment, and subjecting to intensive working thereby to accumulate high-density strain in the base metal and to cause low temperature dynamic recrystallization (also referred to as dynamic continuous recrystallization).

When pure copper and a copper alloy are subjected to the above intensive working using such a technique, heat is generated during working to cause recovery or recrystallization, and thus it is difficult to accumulate desired strain in the base metal. Because the resulting work is thermally unstable after working, elongation of the copper alloy is improved by subjecting to an aging treatment or a strain relief annealing, while the strength tends to decrease.

In contrast, the copper alloy containing Zr changes the entire situation when subjected to the above-mentioned intensive working. When a base metal comprising a copper alloy containing Zr is subjected to intensive working, heat generated during working is less likely to cause recovery or recrystallization, thus making it possible to accumulate desired strain in the base metal. However, when the base metal comprising a copper alloy containing Zr is subjected to intensive working after it was once precipitated, the copper alloy exhibited less improvement in elongation.

In the case of comparing with the copper alloy obtained by forming precipitates after intensive working, it is inferior in stress relaxation resistance, and in spring properties. FIG. 8 is a schematic view showing an example of the precipitation state of a Cu—Zr based compound. As is apparent from FIG. 8, Cu—Zr based precipitates 83 are commonly formed at grain boundaries. Therefore, it is considered to be more effective for the Cu—Zr based precipitates 83 to be formed after increasing the surface area of grain boundaries 82 by refining grains 81 as compared with the case wherein grains 81 are refined after forming Cu—Zr based precipitates 83. In FIG. 8, the symbol 80 denotes a visual field of a microscope.

In addition, a copper alloy containing a high concentration of Ti, Ni, or Sn is used as a base metal having high work hardenability. However, such a copper alloy had a problem that intensive working is hardly conducted and productivity is low. It is known that, in a copper alloy containing a high concentration of Zr, excess Zr segregates at grain boundaries, thereby deteriorating plating properties.

It is known that, when the above-mentioned rolling method is applied to a copper alloy and the copper alloy is rolled at a rolling reduction of not greater than 90%, grains have a large grain size and the copper alloy exhibit small elongation even in the case of a copper alloy containing Zr which heat generated during working is less likely to cause recovery or recrystallization, let alone in the case of a copper alloy free from Zr. Not only in the case of a copper alloy free from Zr also in the case of a copper alloy containing Zr, an intensity ratio of crystal orientation {110}<112> to random orientation was less than 10, and an intensity ratio of crystal orientation {112}<111> to random orientation was greater than 20, as shown in FIG. 6.

Examples of the method for working treatment of a copper alloy include ECAP (Equal Channel Angular Pressing) method described in FURUKAWA, HORITA, NEMOTO, TG. Landon: Metal, 70, 11 (2000), pp. 971; ARB (Accumulative Roll Bonding) method described in NISHIYAMA, SAKAI, SAITO: Journal of the JRICu, 41, 1 (2002), pp. 246; Mechanical Milling method described in TAKAGI, KIMURA: Material, 34, 8 (1995), pp. 959; and multiaxis/multistage working method described in Preliminary Manuscript of 42nd Lecture of Japan Research Institute for Advanced Copper-Base Materials and Technologies, pp. 55; in addition to the above-mentioned rolling method.

Using the methods disclosed in the above documents, the copper alloy is subjected to a working treatment, thus making it possible to refine grains. However, since fine grains having a grain size of not greater than 1 μm are uniformly formed by these methods, a surface area of the grains drastically increases as compared with a conventional crystal structure, which leads to large stress relaxation due to grain boundary diffusion under the environment at high temperature higher than room temperature, thus resulting in poor stress relaxation resistance. When employing these methods, it was very difficult to reconcile an improvement in strength due to grain refinement, and stress relaxation resistance.

As described above, when the strength of the copper alloy is increased by the rolling method, a technique of increasing the rolling reduction has conventionally been employed. When the rolling reduction is set to a high value, the strength of the copper alloy increases, while the elongation decreases and bendability tends to deteriorate. Therefore, it has been desired to develop a copper alloy which is excellent in three respects, for example, strength, elongation, and bendability, and a method of controlling a crystal structure with excellent stress relaxation resistance.

SUMMARY OF THE INVENTION

The present invention provides a copper alloy which is excellent in strength and elongation and has good bendability, and is also excellent in stress relaxation resistance, and a method of manufacturing a copper alloy which can increase the strength of a base metal comprising a copper alloy and improve the elongation by increasing the rolling reduction in the case of increasing the strength of the base metal using a rolling method, thus making it possible to manufacture a copper alloy which has good bendability and is also excellent in stress relaxation resistance.

The copper alloy of the present invention contains at least zirconium in an amount of not less than 0.005% by weight and not greater than 0.5% by weight, including a first grain group including grains having a grain size of not greater than 1.5 μm, a second grain group including grains having a grain size of greater than 1.5 μm and less than 7 μm, the grains having a form which is elongated in one direction, and a third grain group including grains having a grain size of not less than 7 μm, and also the sum of α and β is greater than γ, and α is less than β, where α is a total area ratio of the first grain group, β is a total area ratio of the second grain group, and γ is a total area ratio of the third grain group, based on a unit area, and α+β+γ=1.

The copper alloy of the present invention is in a form wherein three grain groups, for example, a first grain group, a second grain group, and a third grain group coexist. The first grain group includes grains having a mean grain size of not greater than 1.5 μm, while the second grain group includes grains having a grain size of greater than 1.5 μm and less than 7 μm, the grains having the form of being elongated in one direction, and the third grain group includes grains greater than the second grain group, that is, grains having a grain size of not less than 7 μm. The first grain group includes very fine grains having a grain size of not greater than 1.5 μm and therefore imparts good balance between the strength and elongation to the copper alloy. The second grain group and the third grain group include grains greater than those constituting the first grain group and therefore suppress deterioration of stress relaxation resistance. The second grain group and the third grain group were distinguished by the grain size of 7 μm because the strength and elongation are improved when the total area ratio of grains having a grain size of not greater than 7 μm exceeds 0.5. The form composed of three grain groups is recognized in a copper alloy containing at least zirconium in an amount of not less than 0.005% by weight and not greater than 0.5% by weight.

The copper alloy, which satisfies such conditions that the sum of α and β is greater than γ, and α is less than β, where α is a total area ratio of the first grain group, β is a total area ratio of the second grain group, and γ is a total area ratio of the third grain group, based on a unit area, and α+β+γ=1, can be provided with high strength, great bendability, and excellent stress relaxation resistance.

In the copper alloy of the present invention, α may be not less than 0.02 and not greater than 0.40, and β may be not less than 0.40 and not greater than 0.70. In this case, the copper alloy exhibits optimum balance between the strength, elongation, bendability, and stress relaxation resistance. For example, a copper alloy with the composition of Cu-0.101% by weight Zr has a tensile strength of not less than 390 N/mm$^2$ and an elongation of not less than 4%, and also has stress relaxation resistance of not less than 70% even after heating at 205° C. for 1000 hours.

In the copper alloy of the present invention, a mean value of an aspect ratio of the second and third grain groups is not less than 0.24 and not greater than 0.45, where a is the length in the major axis direction, b is the length in the minor axis direction, and the aspect ratio is a value obtained by dividing b by a is in grains constituting the second and third grain groups. In this case, there can be provided a copper alloy wherein anisotropy of mechanical properties such as strength and elongation is suppressed. The present inventors believe that the form, wherein fine grains and coarse grains are used in combination, serves to suppress cross-slip formed at the interface between grains, thereby to impart good balance between the strength and elongation to the copper alloy, and to prevent deterioration of stress relaxation resistance recognized in the copper alloy composed only of fine grains. It was recognized that the copper alloy containing at least zirconium in an amount of not less than 0.005% by weight and not greater than 0.5% by weight exhibits good balance between the strength and elongation and also has excellent bendability.

In the copper alloy of the present invention, an intensity ratio of crystal orientation {110}<112> to random orientation may be not less than 10, and an intensity ratio of crystal orientation {112}<111> to random orientation may be not greater than 20. Such a relation of the intensity ratio is measured by evaluating a relationship between the Eulerian angle (Fai) and the X-ray diffraction intensity to random orientation in the copper alloy. The relation of the intensity ratio shows that a rolling texture of the copper alloy converts into the Brass-type from the pure Cu type. This change in rolling texture accelerates formation of a shear band and causes grain refinement.

The above-mentioned crystal orientation is designated based on the following definition. That is, in a crystal grain of a sheet-like copper alloy obtained by rolling a copper alloy into a sheet, when (hkl) represents a plane parallel to a rolling plane and [uvw] represents a direction parallel to a rolling direction, the crystal orientation of this crystal grain is an orientation (hkl)[uvw].

The copper alloy of the present invention may contain one or two or more kinds of elements selected from among chromium, silicon, magnesium, aluminum, iron, titanium, nickel, phosphorus, tin, zinc, calcium and cobalt in an amount of not less than 0.001% by weight and not greater than 3.0% by weight. In this case, the strength can be further improved.

The copper alloy of the present invention may contain one or two or more kinds selected from oxides of one or two or more kinds of elements among chromium, silicon, magnesium, aluminum, iron, titanium, nickel, phosphorus, tin, zinc, calcium and cobalt, carbon and oxygen in an amount of not less than 0.0005% by weight and not greater than 0.005% by weight. In this case, the above-mentioned oxides, carbon atom and oxygen atom effectively serve as a fracture point during press blanking and therefore improve press blanking properties, thus reducing die wear.

A method of manufacturing a copper alloy of the present invention includes at least a first step of subjecting a base metal including a copper alloy containing at least zirconium (Zr) in an amount of not less than 0.005% by weight and not greater than 0.5% by weight to a solution treatment or a hot rolling treatment, and a second step of subjecting the base metal, which has gone through the first step, to cold rolling at a rolling reduction of not less than 90%.

According to the method of manufacturing a copper alloy of the present invention, it is made possible to refine grains constituting the copper alloy and to improve the strength and elongation of the copper alloy by including at least the first step of subjecting a base metal including a copper alloy containing a small amount of Zr to a solution treatment or a hot rolling treatment, and a second step of the base metal, which has gone through the first step, to cold rolling at a rolling reduction of not less than 90%. Therefore, when the strength of the base metal is increased by using a rolling method, the strength of the base metal including the copper alloy can be increased and also the elongation can be improved by increasing the rolling reduction. As a result, a copper alloy having good bendability can be manufactured.

Since the first and second steps constituting the method of manufacturing the copper alloy of the present invention can be applied to the existing mass-production facility, it is made possible to manufacture a copper alloy, which has the above-mentioned strength and elongation in a good balance and also has good bendability, in commercial quantity without increasing the manufacturing cost while performing a trial for cost reduction.

The method of manufacturing a copper alloy of the present invention may further include a third step of subjecting the base metal, which has gone through the second step, to an aging treatment or a strain relief annealing treatment. In this case, Zr and other elements can be precipitated by subjecting the base metal, which has gone through the second step, to the aging treatment or strain relief annealing treatment. Consequently, a copper alloy having high strength and large elongation can be manufactured.

In the method of manufacturing a copper alloy of the present invention, a solid solution in which Zr are dispersed in the copper alloy may be formed by subjecting the base metal to the solution treatment or the hot rolling treatment.

PREFERRED EMBODIMENTS

Preferred examples of the present invention will now be described with reference to the accompanying drawings. The present invention is not limited to the following examples and constituent elements of these examples may be appropriately combined.

An embodiment of the copper alloy of the present invention will now be described with reference to the accompanying drawings. FIG. 1 to FIG. 4 show that the copper alloy of the present invention is characterized by the form wherein a first grain group and a second grain group coexist and others.

Figure 1:
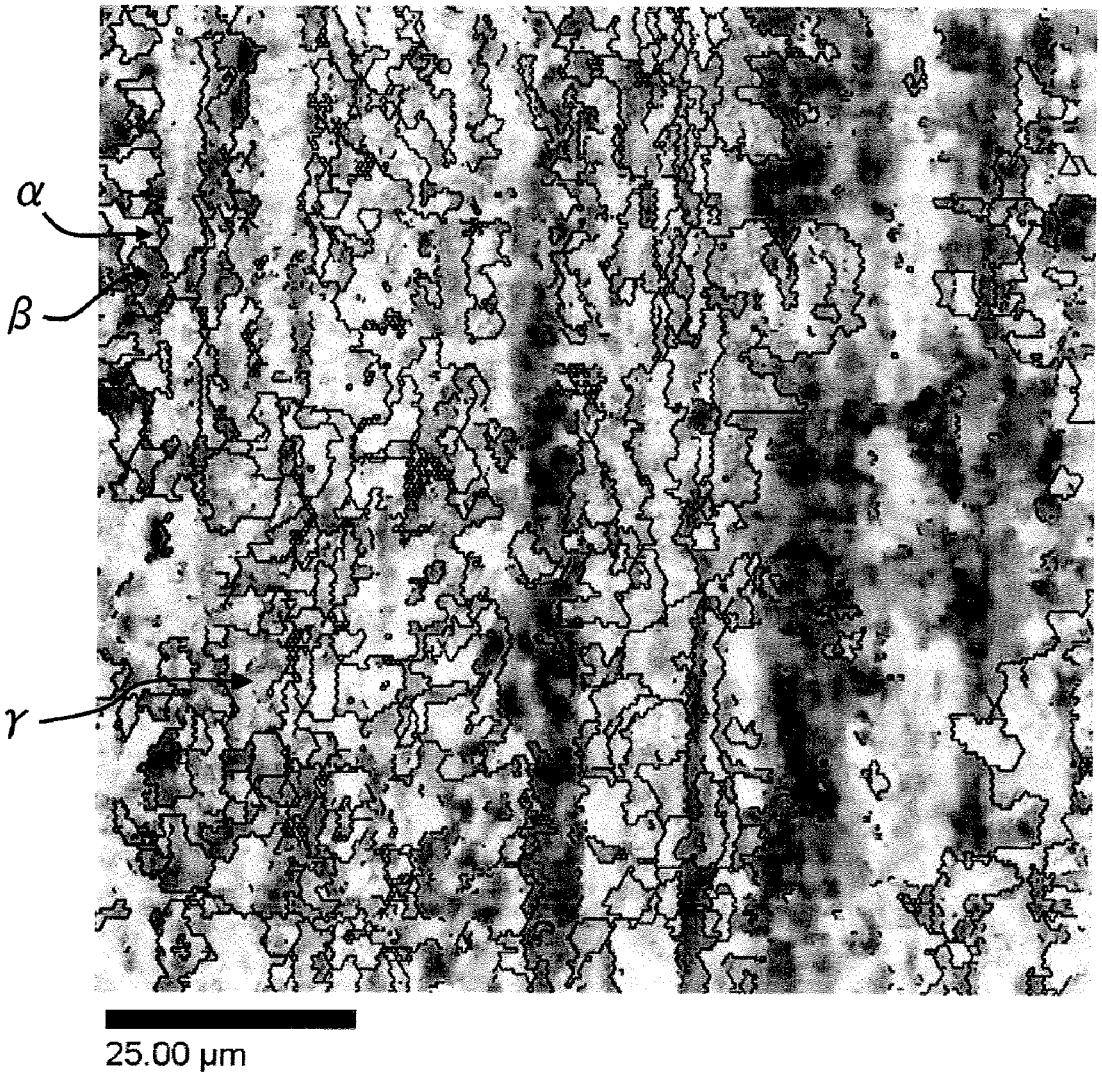
FIG. 1 is a view showing an IPF image of the surface of an example of a copper alloy according to the present invention.

FIG. 1 shows an IPF image of the surface of an example (Example 3) of a copper alloy according to the present invention. This IPF image is obtained by observing over 100 μm-square visual fields of a copper alloy whose surface was electropolished with an aqueous phosphoric acid solution by means of an EBSP analysis of SEM. In FIG. 1, the longitudinal direction of the page is a rolling direction, while the lateral direction is a direction perpendicular to the rolling direction. In FIG. 1, the region with a gray color means that a difference in crystal orientation is 2° and the region with a black color means that a difference in crystal orientation is 15°.

As used herein, IPF [001] is an abbreviation of Inverse Pole Figure [001] and is defined as an inverse pole figure wherein the analyzing direction is a ND axis. In the present invention, the region wherein a change in crystal orientation is not less than 15° was regarded as a crystal grain. As is apparent from the image shown in FIG. 1, in the copper alloy of the present invention, generally circular grains α having a very small grain size, grains β elongated in the rolling direction, having a grain size greater than that of the grains α, and grains γ having a grain size greater than that of the grains β coexist, and the grains β and γ have the form of being elongated in the rolling direction.

Figure 2:
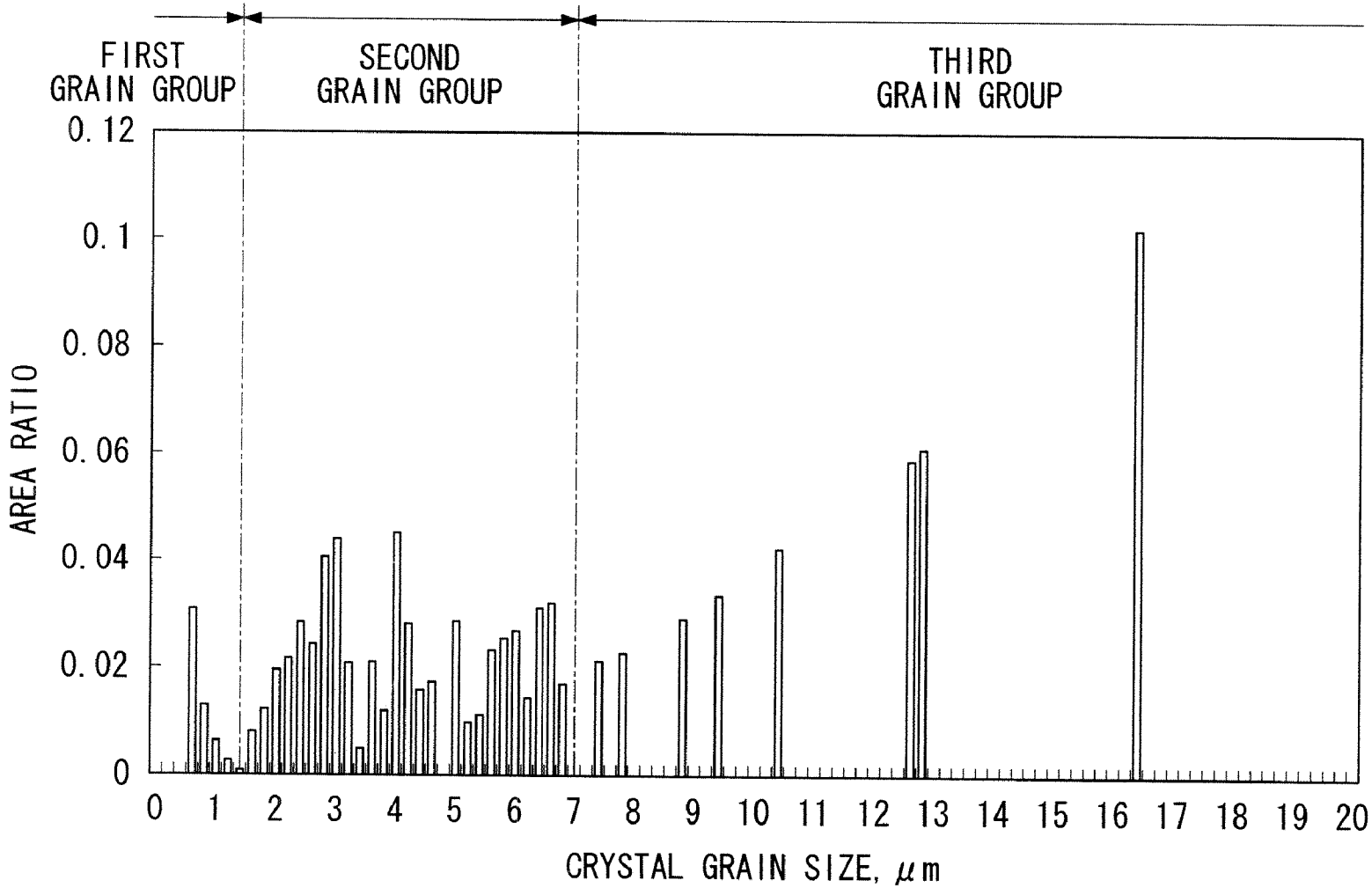
FIG. 2 is a graph showing a relation between the grain size of grains constituting the copper alloy of FIG. 1 and the frequency (area ratio).

FIG. 2 is a graph showing a relationship between the grain size of grains constituting the copper alloy shown in FIG. 1 and the frequency (area ratio).

As is apparent from FIG. 2, the copper alloy of the present invention is composed of a first grain group including grains α having a mean grain size of not greater than 1.5 μm, a second grain group including grains β having a mean grain size greater than that of grains constituting the first grain group, the grain size being distributed with a range from 1.5 μm to 7 μm, and a third grain group comprising grains γ having a mean grain size greater than that of grains constituting the second grain group, the grain size being not less than 7 μm. As described above, the grains β and γ are also characterized by the form of being elongated in one direction (rolling direction).

Figure 3:
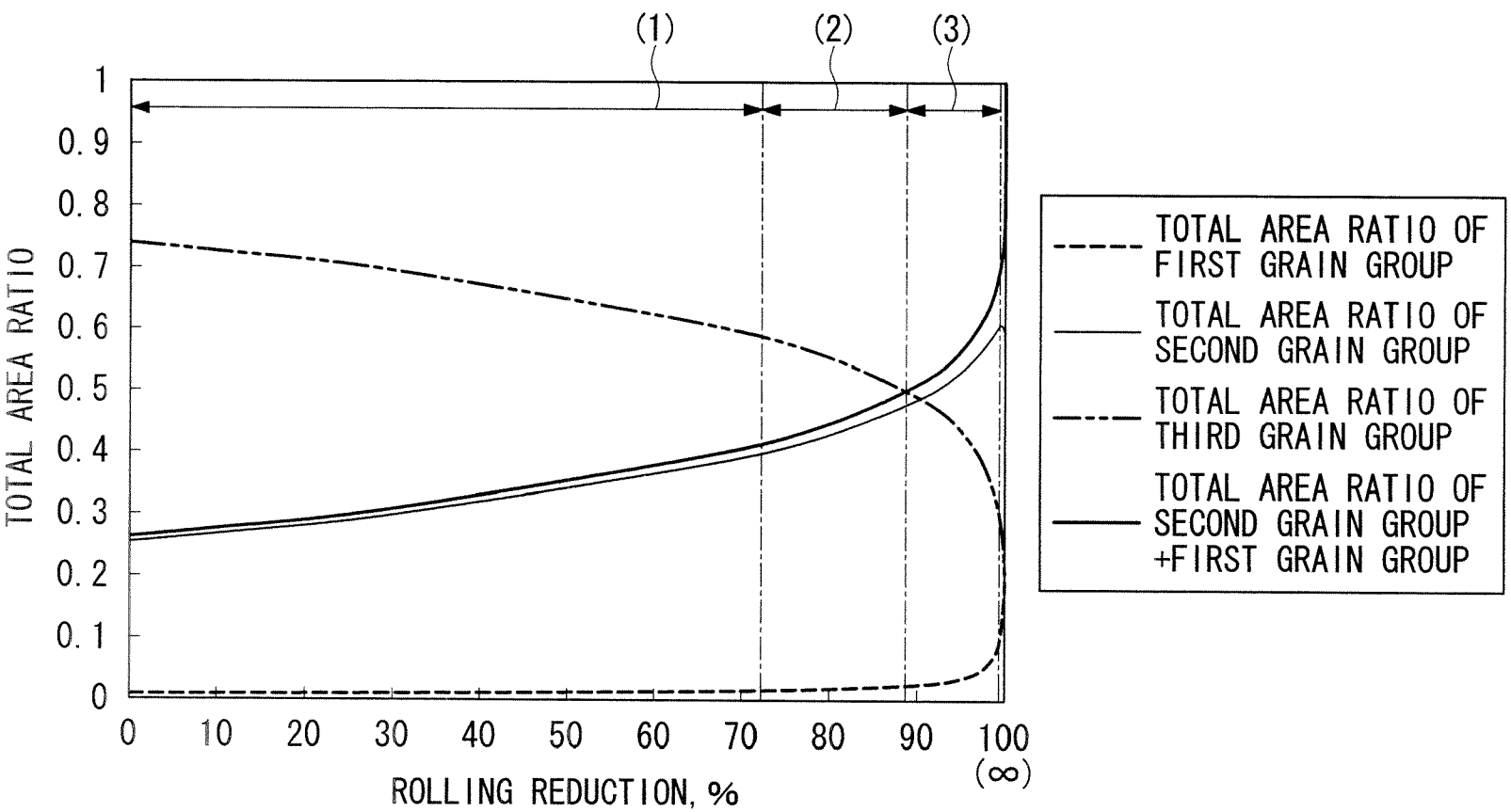
FIG. 3 is a graph showing an example of the relationship between the respective total area ratios α, β and γ of a first grain group to a third grain group, based on a unit area, and the rolling reduction.

FIG. 3 is a graph showing an example of the relationship between the total area ratio α of the first grain group, the total area ratio β of the second grain group and the total area ratio γ of the third grain group, based on a unit area, and the rolling reduction. This graph shows the results obtained by measuring the area ratio of the respective grains with respect to copper alloys manufactured while changing the rolling reduction and totalizing total area ratios α, β and γ of the first grain group to the third grain group, based on a unit area.

Figure 4:
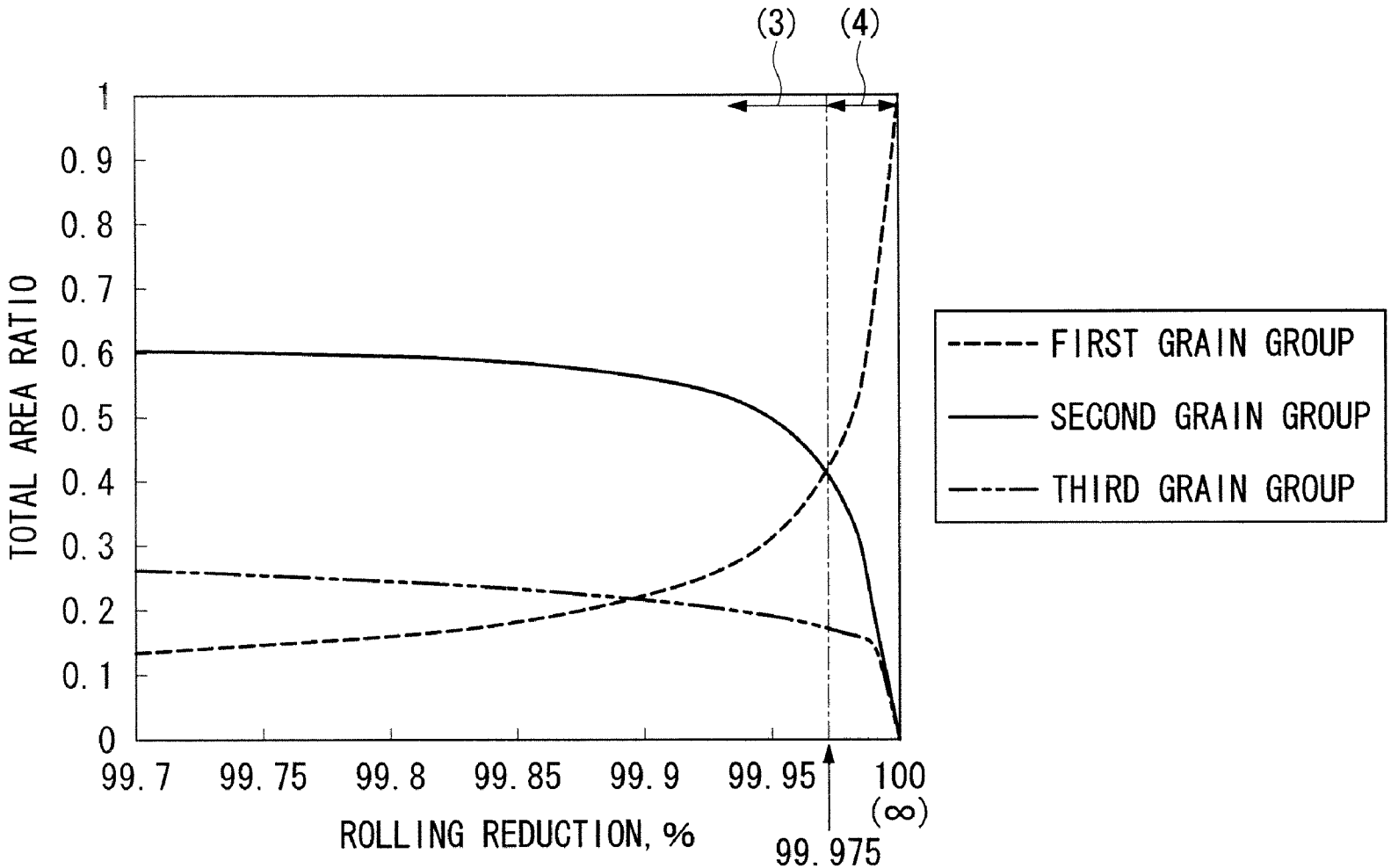
FIG. 4 is a graph showing an enlarged region of the rolling reduction of not less than 99.7 in FIG. 3.

FIG. 4 is a graph showing an enlarged region of the rolling reduction of not less than 99.7 in FIG. 3.

The following points became apparent from FIG. 3 and FIG. 4.

1. Region where the relational expression $\alpha+\beta<\gamma$ is established;

In the case of small rolling reduction (in the case of rolling reduction of less than 90% in FIG. 3), the respective total area ratios of the first grain group to the third grain group satisfy the following expression: $\alpha+\beta<\gamma$ (the range indicated by the regions (1) and (2) in FIG. 3). The copper alloy thus obtained exhibits low strength and elongation and also exhibits excellent stress relaxation resistance (see Table 1 for details).

2. Region where the relational expression $\gamma<\alpha+\beta$ is established;

In the case of large rolling reduction (in the case of rolling reduction of greater than 90% in FIG. 3), the respective total area ratios of the first grain group to the third grain group satisfy the following expression: $\gamma<\alpha+\beta$ (the range indicated by the region (3) in FIG. 3). The copper alloy obtained to satisfy the expression: $\gamma<\alpha+\beta$ exhibits high strength and elongation and also exhibits excellent stress relaxation resistance (see Table 1 for details).

3. Region where the relational expression $\beta<\alpha$ is established;

In the case of very large rolling reduction (in the case of rolling reduction of greater than 99.975% in FIG. 3 and FIG. 4), the respective total area ratios of the first grain group to the third grain group satisfy the following expression: $\beta<\alpha$ (the range indicated by the region (4) in FIG. 4). The copper alloy obtained to satisfy the expression: $\beta<\alpha$ exhibits high strength and elongation, but exhibits poor stress relaxation resistance (see Table 1 for details).

In Table 1, the measurement results of the tensile strength, elongation, and stress relaxation resistance of the copper alloys shown in FIG. 3 and FIG. 4 are summarized.

TABLE 1

| Total area ratio β of the second grain group | Total area ratio α of the first grain group 0-0.02 | 0.02-0.40 | 0.40-1 |
|---|---|---|---|
| 0-0.40 | Third grain group: 0.58 to 1 (FIG. 3 (1)) Rolling reduction: about 72% or less Features: poor strength and elongation because of low rolling reduction, excellent stress relaxation resistance because of large grain size Tensile strength: not greater than 380 N/mm$^2$ Elongation: — Stress relaxation resistance: not less than 70% | Bad: The total area ratio of the second grain group becomes 0.40 or greater when the total area ratio of the first grain group is within this range, and thus this region does not exist substantially in the copper alloy obtained by the manufacturing method according to the present invention. | Third grain group: 0 to 0.20 (FIG. 4 (4)) Rolling reduction: about 99.98% or greater Features: high strength and elongation because of high rolling reduction and fine grains, poor stress relaxation resistance Tensile strength: not less than 500 N/mm$^2$ Elongation: not less than 6% Stress relaxation resistance: not greater than 70% |
| 0.40-0.70 | Third grain group: 0.28 to 0.60 (FIG. 3 (2)) Rolling reduction: about 72 to 88% Features: poor strength and elongation because of insufficient rolling reduction, excellent stress relaxation resistance because of insufficient grain refinement Tensile strength: not greater than 390 N/mm$^2$ Elongation: not greater than 4% Stress relaxation resistance: not less than 70% | Third grain group: 0.50 to 0.16 (FIG. 3 (3), FIG. 4 (3)) Rolling reduction: about 88 to 99.98% Features: high strength, sufficient grain refinement and high elongation because of sufficient rolling reduction, excellent stress relaxation resistance because of good balance of crystal grain sizes Tensile strength: not less than 390 N/mm$^2$ Elongation: not less than 4% Stress relaxation resistance: not less than 70% | Bad: The total area ratio of the second grain group becomes 0.40 or less when the total area ratio of the first grain group is within this range, and thus this region does not exist substantially in the copper alloy obtained by the manufacturing method according to the present invention. |
| 0.70-1 | Bad: It is difficult to realize this region by a rolling method because an initial crystal grain size must be considerably decreased. Even if this region can be realized by the method other than the rolling method, the cost increases and the stress relaxation resistance is not excellent. | | Bad: The total area ratio of the second grain group becomes 0.40 or less when the total area ratio of the first grain group is within this range, and thus this region does not exist substantially in the copper alloy obtained by the manufacturing method according to the present invention. |

As is apparent from Table 1, in the case of the composition of Cu-0.101% by weight Zr, when the total area ratio α of the first grain group is from 0.02 to 0.4 and the total area ratio β of the second grain group is from 0.4 to 0.7, a copper alloy having large tensile strength (not less than 390 N/mm$^2$) and elongation (not less than 4%) as well as excellent stress relaxation resistance (not less than 70%) is obtained.

Figure 5B:
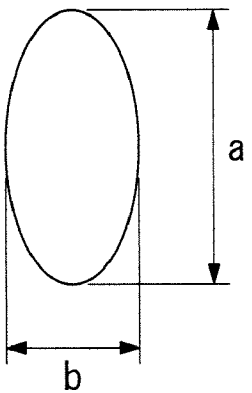
FIG. 5B is a schematic view showing the definition of the aspect ratio.
Figure 5A:
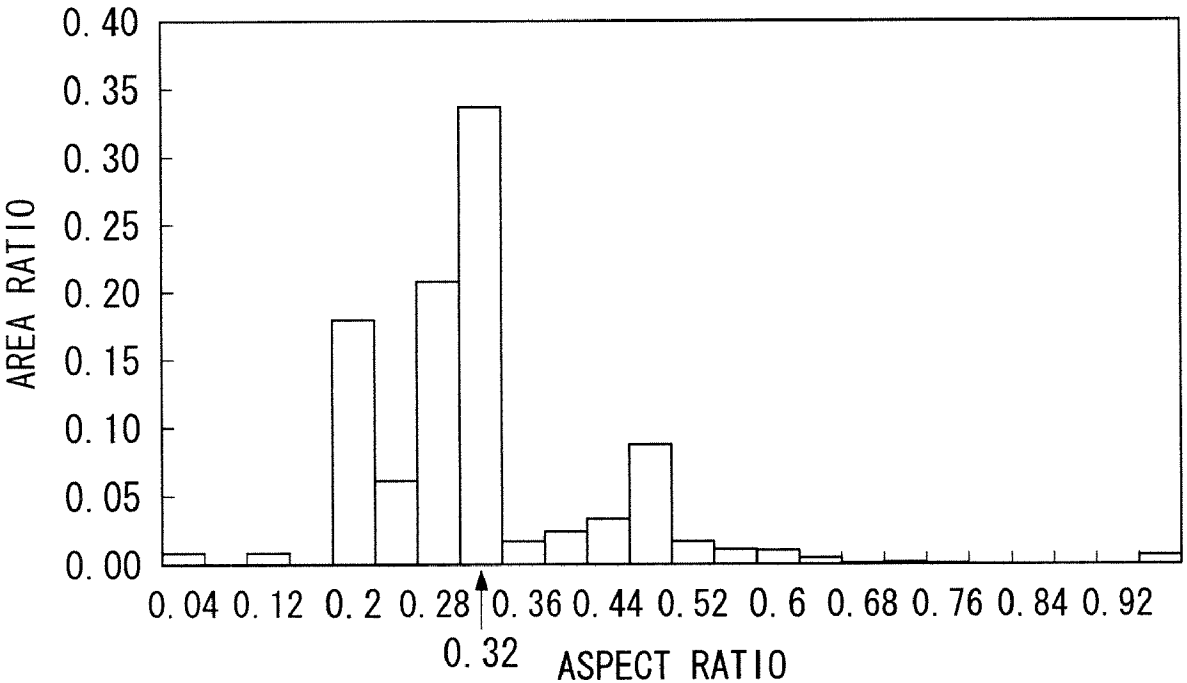
FIG. 5A is a graph showing a relationship between the aspect ratio and the area ratio with respect to grains β constituting a second grain group and grains γ constituting a third grain group of the surface of the copper alloy shown in FIG. 1.

FIG. 5A is a graph showing a relationship between the aspect ratio and the area ratio with respect to grains β constituting a second grain group and grains γ constituting a third grain group of the surface of the copper alloy shown in FIG. 1. In FIG. 5A, the aspect ratio of not less than 0.92 indicates the first grain group α.

FIG. 5B is a schematic view showing the definition of the aspect ratio. As shown in FIG. 5B, the aspect ratio was defined as a value obtained by dividing b by a (b/a), where a is the length in the major axis direction and b is the length in the minor axis direction, in grains β and γ.

As is apparent from the results of FIG. 5A, regarding frequency (area ratio) distribution of the aspect ratio of grains β and γ, the aspect ratio of the grains has a maximum value at about 0.32. The fact that the aspect ratio shows a maximum value at 0.3 means that numerous grains in which the crystal grain size in the longitudinal direction (direction of the major axis) is three times as long as that in the direction of the minor axis exist.

In Table 2 and Table 3, the measurement results of the mean aspect ratio of the second and third grain groups are summarized.

TABLE 2

| Conditions | α | β | Mean aspect ratio of the second and third grain groups 0-0.24 | 0.24-0.45 | 0.45-1 |
|---|---|---|---|---|---|
| A | 0-0.02 | 0-0.40 | Rolling reduction: about 50 to 72% poor strength because of insufficient rolling reduction, small elongation because of work hardening, large anisotropy because of elongated grains in the rolling direction | Rolling reduction: about 30 to 50% low strength because of low rolling reduction, poor elongation because of slightly work hardening, slight anisotropy because of slightly elongated | Rolling reduction: about 0 to 30% low strength because of low rolling reduction, good elongation because of no work hardening, little anisotropy because grains are not elongated in the |

TABLE 2-continued

| Conditions | α | β | Mean aspect ratio of the second and third grain groups 0-0.24 | 0.24-0.45 | 0.45-1 |
|---|---|---|---|---|---|
| | | | | grains in the rolling direction | rolling direction |
| | | | Tensile strength: not greater than 380 N/mm$^2$<br>Elongation: not greater than 4%<br>Anisotropy: not greater than 0.6<br>Stress relaxation resistance: not less than 70% | Tensile strength: not greater than 340 N/mm$^2$<br>Elongation: not less than 4%<br>Anisotropy: not less than 0.6<br>Stress relaxation resistance: not less than 70% | Tensile strength: not greater than 320 N/mm$^2$<br>Elongation: not less than 4%<br>Anisotropy: not less than 0.8<br>Stress relaxation resistance: not less than 70% |
| B | 0-0.02 | 0.40-0.70 | Rolling reduction: about 72 to 88% poor strength because of insufficient rolling reduction, small elongation because of work hardening, large anisotropy because of elongated grains in the rolling direction<br>Tensile strength: not greater than 390 N/mm$^2$<br>Elongation: not greater than 4%<br>Anisotropy: not greater than 0.6<br>Stress relaxation resistance: not less than 70% | Bad: The mean aspect ratios of the second and third grain groups become 0.24 or less when the total area ratios α and β of the first and second grain groups are within these ranges, and thus these regions do not exist substantially in the copper alloy obtained by the manufacturing method according to the present invention. | |

(Note 1)
Anisotropy means (elongation in the TD direction/elongation in the LD direction).
(Note 2)
As anisotropy approaches 1, anisotropy becomes smaller.

TABLE 3

| Conditions | α | β | Mean aspect ratio of the second and third grain groups 0-0.24 | 0.24-0.45 | 0.45-1 |
|---|---|---|---|---|---|
| C | 0.02-0.40 | 0.40-0.70 | Bad: The mean aspect ratios of the second and third grain groups become 0.24 or greater when the total area ratios α and β of the first and second grain groups are within these ranges, and thus these regions do not exist substantially in the copper alloy obtained by the manufacturing method according to the present invention. | (present invention)<br>Rolling reduction: about 88 to 99.98% high strength, refined grains and high elongation because of sufficient rolling reduction, good anisotropy because of proper aspect ratio<br>Tensile strength: not less than 390 N/mm$^2$<br>Elongation: not less than 4%<br>Anisotropy: not less than 0.6<br>Stress relaxation resistance: not less than 70% | Bad: The mean aspect ratios of the second and third grain groups become 0.45 or less when the total area ratios α and β of the first and second grain groups are within these ranges, and thus these regions do not exist substantially in the copper alloy obtained by the manufacturing method according to the present invention. |
| D | 0.40-1 | 0-0.40 | Bad: The mean aspect ratios of the second and third grain groups become 0.45 or greater when the total area ratios α and β of the first and second grain groups are within these ranges, and thus these regions do not exist substantially in the copper alloy obtained by the manufacturing method according to the present invention. | | Rolling reduction: not less than 99.98% high strength and elongation, and slight anisotropy because of high rolling reduction and considerably refined grains, but drastically poor stress relaxation resistance<br>Tensile strength: not less than 495 N/mm$^2$<br>Elongation: not less than 5%<br>Anisotropy: not less than 0.6<br>Stress relaxation resistance: not greater than 70% |

Under the conditions C shown in Table 3, when the mean aspect ratios of the second and third grain groups are from 0.24 to 0.45, large tensile strength (not less than 390 N/mm$^2$) and elongation (not less than 4%), and excellent stress relaxation resistance (not less than 70%) can be obtained. It was found that anisotropy of elongation (anisotropy of one of mechanical properties) may be not less than 0.6 because the aspect ratio is not too small.

As described above, the copper alloy of the present invention is in a form wherein the first and second grain groups coexist. The first grain group is composed of very fine grains having a grain size of not greater than 1.5 μm and therefore impart good balance between the strength and elongation to the copper alloy.

The second grain group is composed of grains having a grain size greater than that of grains constituting the first grain group and therefore suppresses deterioration of stress relaxation resistance. As a result, it is made possible to obtain a copper alloy which has good balance between the strength and elongation, and also has excellent stress relaxation resistance.

Table 4 and Table 5 show the test results of copper alloys containing additive elements (in the case of selecting one or two or more kinds of elements among chromium, silicon, magnesium, aluminum, iron, titanium, nickel, phosphorus, tin, zinc, calcium, cobalt, carbon and oxygen). In Table 4 and Table 5, the measurement results of various characteristics ((i) mean grain size and mean aspect ratio of the first grain group, (ii) mean grain size and mean aspect ratio of the second grain group, (iii) tensile strength, elongation and spring limit value for each collection direction, (iv) conductivity, and (v) intensity ratio of crystal orientation {110}<112> to random orientation and intensity ratio of crystal orientation {112}<111> to random orientation) of the cooper alloys are summarized.

TABLE 4

| | | Components [% by weight] | | | | | Total area ratio | | | Mean aspect ratio |
|---|---|---|---|---|---|---|---|---|---|---|
| | | Cu | Zr | Elements other than Cu, Zr, C and O | C | O | First grain group | Second grain group | Third grain group | Second and third grain groups |
| Examples | 1 | Balance | 0.101 | — | 0.0003 | 0.0003 | 0.077 | 0.563 | 0.360 | 0.31 |
| | 2 | Balance | 0.103 | Cr = 0.273 | 0.0002 | 0.0007 | 0.057 | 0.553 | 0.390 | 0.35 |
| | 3 | Balance | 0.098 | Cr = 0.246, Si = 0.018 | 0.0003 | 0.0009 | 0.053 | 0.578 | 0.369 | 0.30 |
| | 4 | Balance | 0.095 | Cr = 0.256, Si = 0.024, Mg = 0.030 | 0.0004 | 0.0005 | 0.055 | 0.568 | 0.377 | 0.28 |
| | 5 | Balance | 0.073 | Cr = 0.296, Si = 0.021, Co = 0.05 | 0.0003 | 0.0007 | 0.055 | 0.542 | 0.403 | 0.35 |
| | 6 | Balance | 0.085 | Cr = 0.302, Al = 0.054, Ca = 0.004 | 0.0003 | 0.0006 | 0.051 | 0.587 | 0.362 | 0.33 |
| | 7 | Balance | 0.075 | Cr = 0.144, Al = 0.053, Fe = 0.187, Ti = 0.100 | 0.0003 | 0.0006 | 0.044 | 0.548 | 0.408 | 0.32 |
| | 8 | Balance | 0.100 | Mg = 0.68, P = 0.004 | 0.0003 | 0.0003 | 0.043 | 0.586 | 0.371 | 0.38 |
| | 9 | Balance | 0.076 | Si = 0.39, Ni = 1.58, Sn = 0.41, Zn = 0.48 | 0.0002 | 0.0007 | 0.056 | 0.587 | 0.357 | 0.26 |
| | 10 | Balance | 0.080 | Fe = 2.21, P = 0.032, Zn = 0.13 | 0.0003 | 0.0009 | 0.042 | 0.563 | 0.395 | 0.39 |
| Comparative Examples | 1 | Balance | 0.098 | Cr = 0.246, Si = 0.018 | 0.0003 | 0.0009 | 0.015 | 0.396 | 0.589 | 0.16 |
| | 2 | Balance | 0.098 | Cr = 0.246, Si = 0.018 | 0.0003 | 0.0009 | 0.480 | 0.358 | 0.162 | 0.47 |
| | 3 | Balance | 0.004 | Cr = 0.252, Si = 0.021 | 0.0003 | 0.0009 | 0.019 | 0.388 | 0.593 | 0.19 |

TABLE 5

| | | Collection direction | Tensile strength [N/mm$^2$] | Elongation [%] | Spring limit value [N/mm$^2$] | Conductivity [% IACS] | Intensity ratio of crystal orientation [110]<112> to random orientation | Intensity ratio of crystal orientation [112]<111> to random orientation | Residual stress rate (%) after exposure at 205° C. for 1000 hours |
|---|---|---|---|---|---|---|---|---|---|
| Examples | 1 | L.D. | 503 | 10 | 306 | 87 | 19.3 | 12.2 | 77.3 |
| | | T.D. | 506 | 9 | 335 | | | | |
| | 2 | L.D. | 567 | 11 | 390 | 85 | 23.3 | 9.3 | 77.8 |
| | | T.D. | 572 | 10 | 390 | | | | |
| | 3 | L.D. | 585 | 10 | 425 | 85 | 22.3 | 8.9 | 80.7 |
| | | T.D. | 589 | 11 | 464 | | | | |
| | 4 | L.D. | 644 | 9 | 532 | 79 | 22.9 | 9.9 | 76.9 |
| | | T.D. | 668 | 10 | 599 | | | | |
| | 5 | L.D. | 588 | 11 | 423 | 83 | 23.8 | 10.8 | 79.2 |
| | | T.D. | 591 | 12 | 431 | | | | |
| | 6 | L.D. | 583 | 12 | 405 | 84 | 22.7 | 12.1 | 77.9 |
| | | T.D. | 587 | 10 | 417 | | | | |
| | 7 | L.D. | 636 | 10 | 525 | 76 | 23.6 | 12.1 | 80.6 |
| | | T.D. | 638 | 9 | 547 | | | | |

TABLE 5-continued

| | | Collection direction | Tensile strength [N/mm$^2$] | Elongation [%] | Spring limit value [N/mm$^2$] | Conductivity [% IACS] | Intensity ratio of crystal orientation [110]<112> to random orientation | Intensity ratio of crystal orientation [112]<111> to random orientation | Residual stress rate (%) after exposure at 205° C. for 1000 hours |
|---|---|---|---|---|---|---|---|---|---|
| | 8 | L.D. | 615 | 9 | 432 | 61 | 23.2 | 10.0 | 72.2 |
| | | T.D. | 637 | 8 | 512 | | | | |
| | 9 | L.D. | 753 | 8 | 572 | 43 | 23.1 | 11.3 | 74.5 |
| | | T.D. | 755 | 8 | 647 | | | | |
| | 10 | L.D. | 574 | 7 | 303 | 59 | 22.3 | 10.5 | 71.3 |
| | | T.D. | 583 | 6 | 332 | | | | |
| Comparative Examples | 1 | L.D. | 514 | 4 | 372 | 88 | 6.6 | 26.9 | 89.3 |
| | | T.D. | 501 | 1 | 380 | | | | |
| | 2 | L.D. | 591 | 12 | 432 | 84 | 23.4 | 8.2 | 62.1 |
| | | T.D. | 593 | 11 | 431 | | | | |
| | 3 | L.D. | 482 | 18 | 335 | 91 | 9.7 | 21.2 | 65.4 |
| | | T.D. | 512 | 6 | 385 | | | | |

The following aspects are apparent from Table 4 and Table 5.

(1) When the copper alloy contains these elements (one or two or more kinds of elements among chromium, silicon, magnesium, aluminum, iron, titanium, nickel, phosphorus, tin, zinc, calcium, and cobalt) in an amount of not less than 0.001% by weight and not greater than 3.0% by weight, the strength can be further enhanced.

(2) When the copper alloy contains one or two or more kinds selected from oxides of one or two or more kinds of elements among chromium, silicon, magnesium, aluminum, iron, titanium, nickel, phosphorus, tin, zinc, calcium and cobalt, carbon atom and oxygen atom in an amount of not less than 0.0005% by weight and not greater than 0.005% by weight, the above-mentioned oxides, carbon atom and oxygen atom effectively serve as a fracture point during press blanking and therefore improve press blanking properties, thus reducing die wear.

Figure 6:
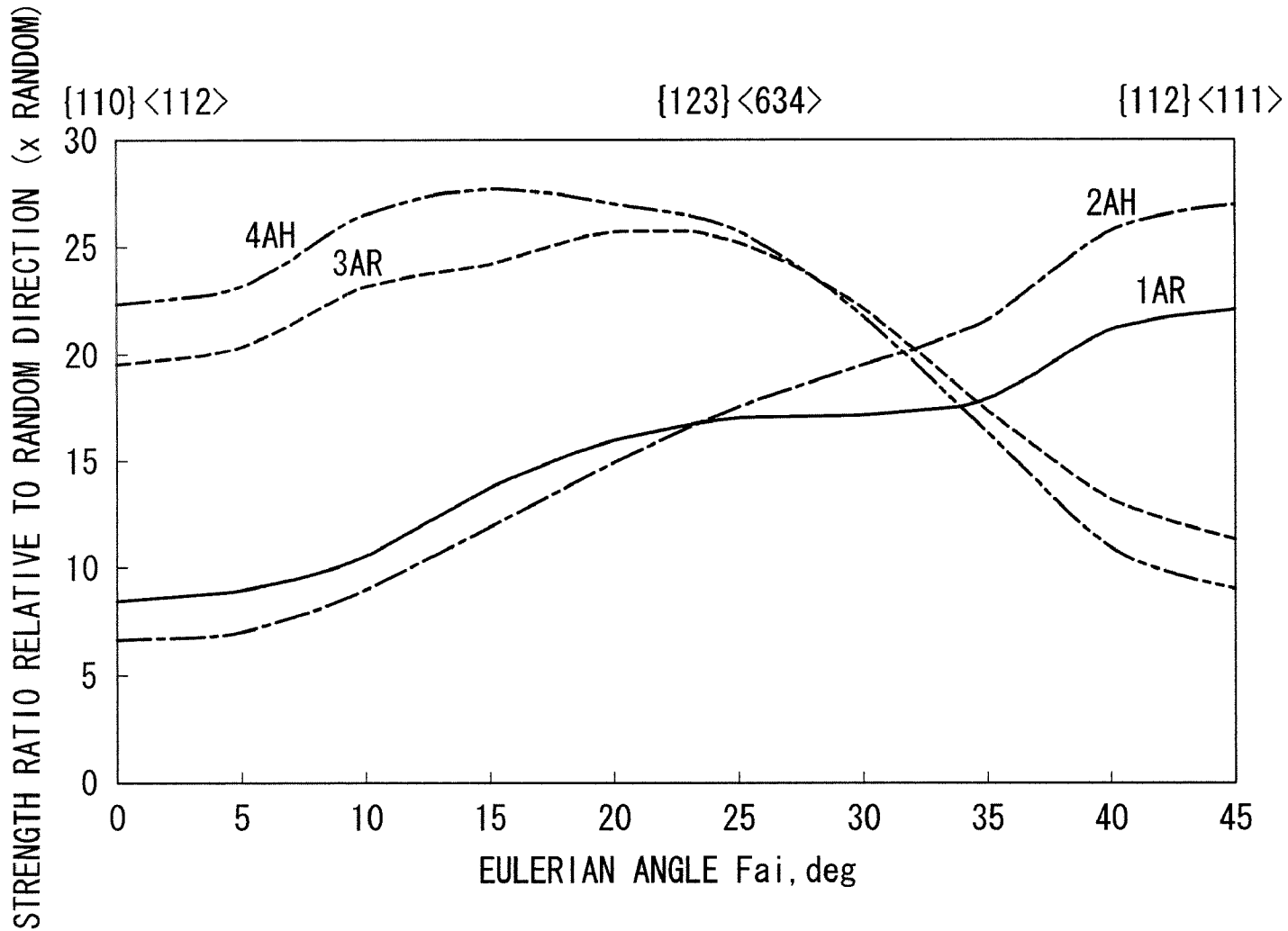
FIG. 6 is a graph showing the examination results of the texture of the copper alloy in FIG. 1 (Example 3) and copper alloys obtained by changing manufacturing conditions.

(3) In the copper alloy of the present invention wherein an intensity ratio of crystal orientation {110}<112> to random orientation is not less than 10, and an intensity ratio of crystal orientation {112}<111> to random orientation is not greater than 20, as shown in FIG. 6, a rolling texture of the copper alloy converts into the Brass-type from the pure Cu type. This change in rolling texture accelerates formation of a shear band and causes grain refinement.

<Die Wear Test by Press Blanking>

Using a commercially available die made of a WC based cemented carbide, 1,000,000 holes having a diameter of 2 mm were made in various strip materials (members obtained by winding a thin sheet in the form of a coil) by press blanking. At this time, a change between a mean pore size of initial 10 holes made in the strip materials and a mean pore size of final 10 holes was divided by 1,000,000 to obtain a mean change rate. A relative ratio of each of the resulting mean change rates to the mean change rate of Comparative Example 4 (the mean change rate being regarded as 1) was determined and evaluated. The strip material having smaller mean change rate is less likely to cause die wear. The results are shown in Table 6.

TABLE 6

| | Cu | Zr | Cr | Si | C | O | Relative ratio of mean change rate of die wear due to press blanking (based on 1 in case of Comparative Example 4) |
|---|---|---|---|---|---|---|---|
| Example 3 | Balance | 0.098 | 0.246 | 0.018 | 0.0003 | 0.0009 | 0.49 |
| Comparative Example 4 | Balance | 0.103 | 0.257 | 0.022 | <0.0001 | <0.0001 | 1.00 |

The copper alloy of the present invention can be manufactured by the method including at least a first step of subjecting a base metal including a copper alloy containing at least zirconium (Zr) in an amount of not less than 0.005% by weight and not greater than 0.5% by weight to a solution treatment (or hot rolling treatment), and a second step of subjecting the base metal, which has gone through the first step, to cold rolling at a rolling reduction of not less than 90%. These two steps cause grain refinement constituting the copper alloy, thus making it possible to improve the strength and elongation of the copper alloy.

The solution treatment constituting the first step refers to a hot rolling treatment performed at the temperature of about 980° C. and the following quenching treatment that employs a water cooling operation. The cold rolling at a rolling reduction of not less than 90%, which constitutes the second step, is a cold strong rolling at a rolling reduction of not less than 90%, and preferably cold strong rolling under conditions that the thickness is reduced within a range from 0.25 to 0.13 mm in 16 passes (the number of rolling operations) at a rolling reduction of 98% to 99%.

A third step of subjecting the base metal, which has gone through the second step, to an aging treatment or a strain relief annealing treatment may be conducted. In this case, a copper alloy having higher strength and large elongation can be manufactured by depositing Zr and other elements.

The aging treatment constituting the third step is conducted by standing at an atmospheric temperature of 400° C. for 4 to 5 hours. Then, the base metal may be appropriately subjected to a shape modification treatment using a tension leveler (TL), or to a strain relief annealing at the temperature within a range from 400 to 450° C.

In contrast, according to a conventional method of manufacturing a copper alloy, a second-stage rolling treatment has been employed. The method includes subjecting a base metal sequently to a solution treatment, a first-stage cold rolling (under the conditions that the thickness is reduced to about 1.0 to 4.0 mm at a rolling reduction of not greater than 90%), an aging treatment, and a second-stage cold rolling (under the conditions that the thickness is reduced to about 0.15 mm at a rolling reduction of about 70 to 98%).

The measurement results of the tensile strength, elongation, Vickers hardness, spring limit value, and conductivity of copper alloys manufactured by considerably different methods are summarized in Table 7. In the case of a conventional method, the rolling reduction after the solution treatment or hot rolling treatment is low, while the rolling reduction is higher than that of the conventional method in the case of the method of the present invention. In Table 7, the copper alloy obtained by the method of the present invention is referred to as a sample 1 (Example 3) and the copper alloy obtained by a conventional method is referred to as a sample 2.

The tensile strength ($N/mm^2$) is a numerical value measured by an INSTRON universal testing machine using a JIS No. 5 specimen. The elongation (%) is a numerical value measured by elongation at breakage at a gauge length of 50 mm. The Vickers hardness (HV) is a numerical value measured by the procedure defined in JIS (Z2244). The spring limit value $Kb_{0.1}$ ($N/mm^2$) is a numerical value measured by the procedure defined in JIS (H3130). The conductivity (% IACS) is a numerical value measured by the procedure defined in JIS (H0505).

TABLE 7

| Samples | Tensile strength [$N/mm^2$] | Elongation [%] | Vickers hardness [HV] | Spring limit value $Kb_{0.1}$ [$N/mm^2$] | Conductivity [% IACS] |
|---|---|---|---|---|---|
| 1 | 585 | 10.4 | 168 | 425 | 85 |
| 2 | 535 | 9.9 | 157 | 336 | 79 |

As is apparent from Table 7, the copper alloy (sample 1) obtained by the method of the present invention exhibits improved numerical values in all evaluation items as compared with the copper alloy (sample 2) obtained by a conventional method. These results revealed that a copper alloy having good balance between the strength and elongation as well as excellent bendability can be manufactured by the method of the present invention.

Figure 7:
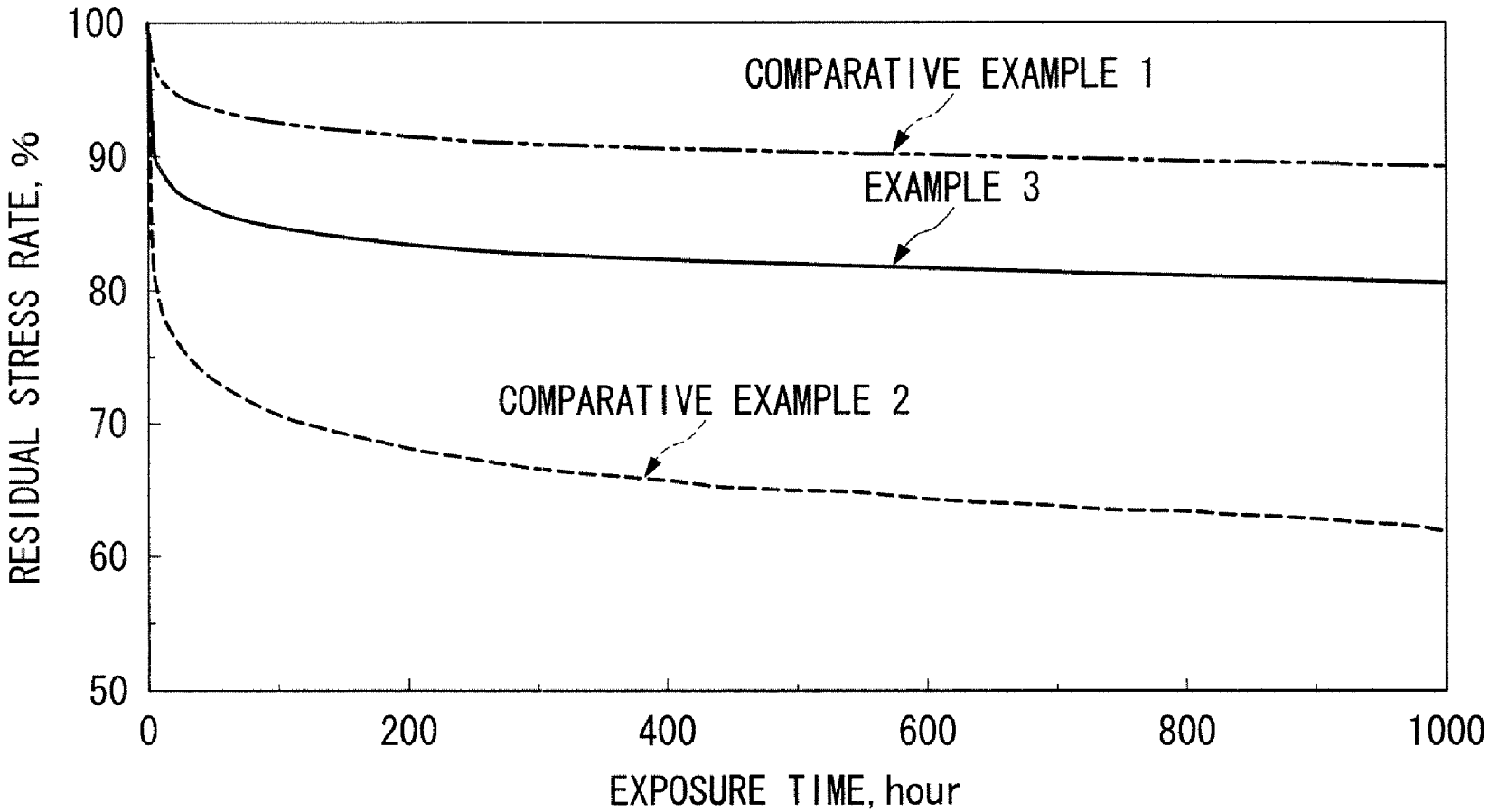
FIG. 7 is a graph showing stress relaxation resistance of Example 3, Comparative Example 1, and Comparative Example 2.
Figure 8:
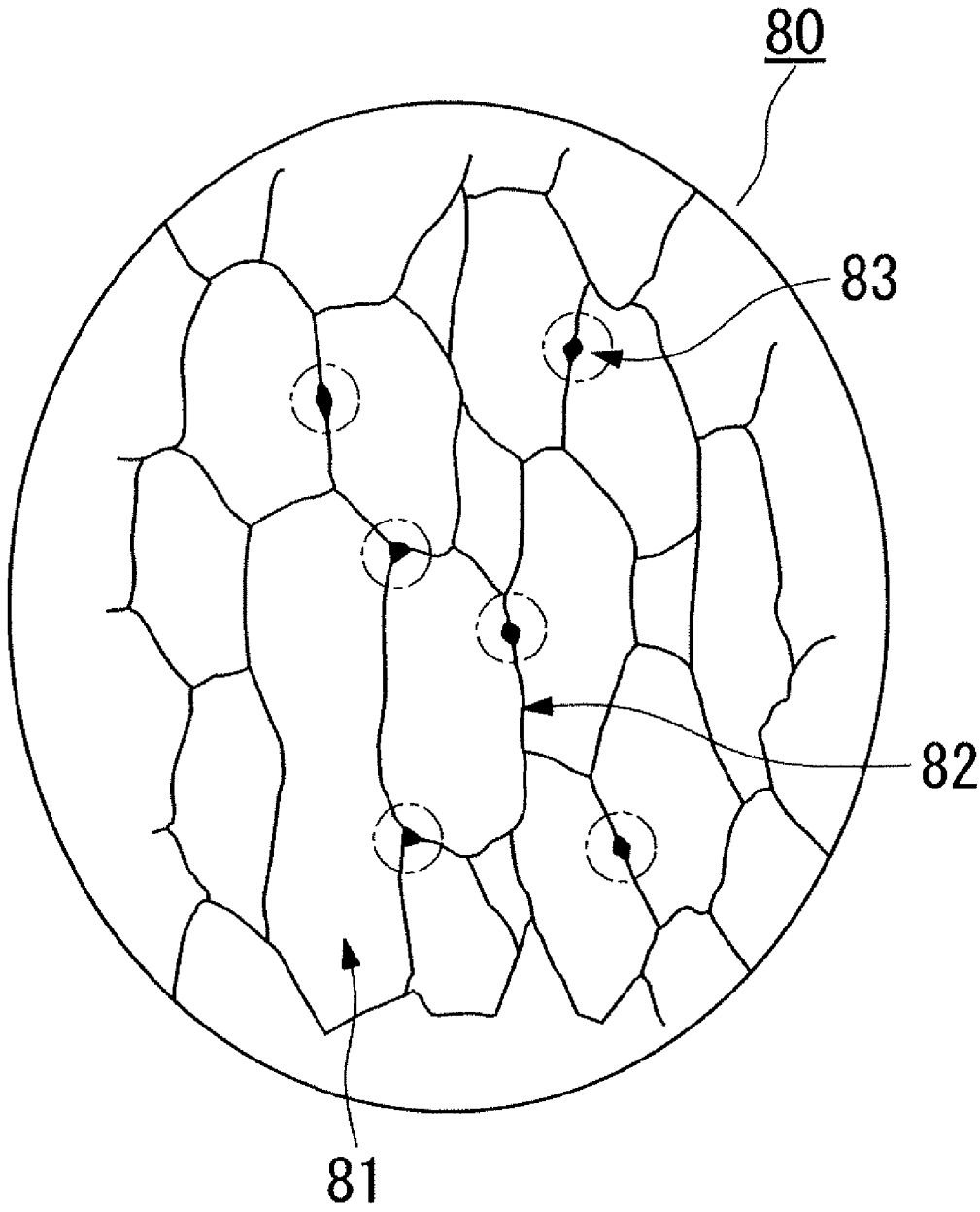
FIG. 8 is a schematic view showing an example of the precipitation state of a Cu—Zr based compound.

FIG. 7 is a graph showing stress relaxation resistance of Example 3, Comparative Example 1, and Comparative Example 2 in Table 4 and Table 5, in which the abscissa denotes time (hour) exposed in an atmosphere at a temperature of 205° C. and the ordinate denotes residual stress rate (%). The residual stress rate is a numerical value determined by measuring permanent strain after exposure for a predetermined time.

The residual stress test was conducted by applying a bending stress to a test piece having a width of 10 mm and a length of 80 mm using a jig with a cantilever arm. Initial flexural displacement $\delta_0$ was given so that the applied stress accounts for 80% of a 0.2% proof stress of each material. Before heating, the test specimen was allowed to stand at room temperature for a predetermined time in the state of applying the stress, and the position after removal of the stress was taken as a reference level. Then, the test specimen was exposed in an atmosphere for a predetermined time in a thermostatic oven. After removal of the stress, permanent flexural displacement $\delta_t$ from the reference level was measured and a residual stress rate was calculated. In the calculation, the following equation was used.

$$\text{Residual stress rate (\%)}=(1-\delta_t/\delta_0)\times 100$$

As is apparent from FIG. 7, regarding the copper alloy obtained in Comparative Example 2, the residual stress rate decreases to 80% within a very short exposure time of about 50 hours, and then residual stress rate tends to gradually decrease over time. Regarding the copper alloy (sample 1) of Example 3 obtained by the method of the present invention, the residual stress rate tends to gradually decrease over time, while the residual stress rate maintains a numerical value of greater than 80% even after the exposure time of 1000 hours have passed. As is apparent from the results, the copper alloy (sample 1) of Example 3 of the present invention has excellent stress relaxation resistance.

The present inventors examined the texture of copper alloys obtained by rolling at two kinds of rolling reduction after a solution treatment or hot rolling treatment using a base metal with the same composition.

FIG. 6 is a graph showing the examination results of a texture of the copper alloy in FIG. 1 and copper alloys obtained by changing manufacturing conditions, in which the abscissa denotes Eulerian angle Fai (deg) and the ordinate denotes intensity ratio to random orientation. The intensity ratio at the Eulerian angle of 0 (deg) indicates an intensity ratio of crystal orientation {110}<112> to random orientation. The intensity ratio at 25 (deg) indicates an intensity ratio of crystal orientation {123}<634> to random orientation, and the intensity ratio at 45 (deg) indicates an intensity ratio of crystal orientation {112}<111> to random orientation.

In FIG. 6, the dotted line (3AR) and the two-dot chain line (4AH) correspond to the case of a copper alloy manufactured by the method of the present invention, and the former corresponds to a copper alloy obtained by subjecting to the first and second steps (as rolled material) and the latter corresponds to a copper alloy obtained by subjecting to the first to third steps (aged material). The solid line (1AR) and the dashed line (2AH) correspond to a copper alloy manufactured under the conditions of low rolling reduction which is not within the scope of the present invention, and the former and the latter correspond to the same materials as those described above.

As is apparent from FIG. 6, the copper alloy manufactured by the method of the present invention is characterized in that an intensity ratio of crystal orientation {110}<112> to random orientation is not less than 10, and an intensity ratio of crystal orientation {112}<111> to random orientation is not greater than 20.

In contrast, in the case of the copper alloy manufactured under the conditions of low rolling reduction (Comparative Example 1), an intensity ratio of crystal orientation {110}<112> to random orientation is less than 10, and an intensity ratio of crystal orientation {112}<111> to random orientation is greater than 20. As described above, it was confirmed that the texture of the copper alloy of the present invention is quite different from that of the copper alloy manufactured under the conditions of low rolling reduction.

Since the copper alloy of the present invention contains at least a trace amount of zirconium and includes a first grain group including grains having a grain size of not greater than 1.5 μm, and second and third grain groups comprising grains having a grain size of greater than that of grains of the first grain group, and also satisfies the following conditions that the sum of α and β is greater than γ, and α is less than β, where α is a total area ratio of the first grain group, β is a total area ratio of the second grain group, and γ is a total area ratio of the third grain group, based on a unit area, the copper alloy can be provided with high strength, large bendability, and excellent stress relaxation resistance. Therefore, by using the copper alloy of the present invention, it is made possible to provide terminals and connectors, lead frames and copper alloy foils, which are excellent in durability and flexibility.

According to the method of manufacturing the copper alloy of the present invention, when a second step of subjecting a base metal including a copper alloy containing at least zirconium (Zr) in an amount of not less than 0.005% by weight and not greater than 0.5% by weight, which has gone through a first step of subjecting the base metal to a solution treatment (or a hot rolling treatment), to cold rolling at a rolling reduction of not less than 90% is conducted, it leads to increase the strength of the base metal by the rolling method on condition that the rolling reduction is increased. Therefore the strength and elongation of the base metal including the copper alloy can be increased as much as possible, as a result, a copper alloy having good bendability can be manufactured.

Thus, according to the present invention, it is made possible to solve a problem involved in the use of the technique of increasing the rolling reduction in the case of increasing the strength of the copper alloy by a conventional rolling method, that is, such a problem that high rolling reduction increases the strength of the treated copper alloy, but decreases the elongation, thus resulting in poor bendability. The above-mentioned two steps can be applied to the existing mass-production facility and therefore contributes to mass-production of a copper alloy which has good balance between the strength and elongation, and also has good bendability.

The present invention can be applied to a copper alloy which exhibits good bending properties when employed as terminals, connectors, lead frames, and copper alloy foils, and a method of manufacturing the same.

More particularly, the copper alloy of the present invention is excellent in strength and elongation and has good bendability, and is also excellent in stress relaxation resistance. Therefore, this copper alloy is effective to manufacture terminals, connectors, lead frames and copper alloy foils, which are excellent in durability and flexibility. Terminals made of the copper alloy imparts high electrical connection stability in electrical and electronic equipments used in the atmosphere at comparatively high temperature and equipments that require vibration resistance because the terminals are excellent in heat resistance and can exert the effect of relieving impact resistance.

The method of manufacturing a copper alloy of the present invention can be applied to the existing mass-production facility and is therefore excellent in mass productivity, and also requires a singe-stage cold rolling treatment (while a conventional method requires a two-stage cold rolling treatments) and therefore enables remarkable cost reduction, and thus the method of the present invention contributes to cost reduction of the copper alloy.

What is claimed is:

1. A method of manufacturing a copper alloy, the method comprising at least:

a first step of subjecting a base metal comprising a copper alloy containing at least zirconium in an amount of not less than 0.005% by weight and not greater than 0.5% by weight to a solution treatment or a hot rolling treatment, and a second step of subjecting the base metal, which has gone through the first step, to cold rolling at a rolling reduction of not less than 90% so as to obtain a copper alloy comprising: a first grain group comprising grains having a grain size of not greater than 1.5 μm, a second grain group comprising grains having a grain size of greater than 1.5 μm and less than 7 μm, said grains having a form which is elongated in one direction, and a third grain group comprising grains having a grain size of not less than 7 μm;

such that where α is a total area ratio of the first grain group, β is a total area ratio of the second grain group, and γ is a total area ratio of the third grain group, based on a unit area, $\alpha+\beta+\gamma=1$, the sum of α and β is greater than γ, and α is less than β.

2. The method of manufacturing a copper alloy according to claim 1, which further comprises a third step of subjecting the base metal, which has gone through the second step, to an aging treatment or a strain relief annealing treatment.

3. The method of manufacturing a copper alloy according to claim 1, wherein the hot rolling treatment is performed at a temperature of about 980° C., and the solution treatment comprises a hot rolling treatment performed at the temperature of about 980° C.

* * * * *